US011639715B2

(12) United States Patent
Kuang

(10) Patent No.: US 11,639,715 B2
(45) Date of Patent: May 2, 2023

(54) INFLATABLE PUMP

(71) Applicant: GUANGZHOU ANTU ELECTRIC CO., LTD., Guangdong (CN)

(72) Inventor: Xinhua Kuang, Guangdong (CN)

(73) Assignee: GUANGZHOU ANTU ELECTRIC CO., LTD., Guangzhou (CN)

( * ) Notice: Subject to any disclaimer, the term of this patent is extended or adjusted under 35 U.S.C. 154(b) by 440 days.

(21) Appl. No.: 16/865,382

(22) Filed: May 3, 2020

(65) Prior Publication Data

US 2021/0262460 A1 Aug. 26, 2021

(30) Foreign Application Priority Data

Feb. 21, 2020 (CN) ..... 202020197312.7

(51) Int. Cl.

| | |
|---|---|
| ***F04B 39/14*** | (2006.01) |
| ***F04B 39/12*** | (2006.01) |
| ***F04B 53/16*** | (2006.01) |
| ***F04B 53/22*** | (2006.01) |

(52) U.S. Cl.

CPC ..... *F04B 39/14* (2013.01); *F04B 39/121* (2013.01); *F04B 39/125* (2013.01); *F04B 39/127* (2013.01); *F04B 53/162* (2013.01); *F04B 53/22* (2013.01)

(58) Field of Classification Search

CPC ..... F04B 53/22; F04B 53/162; F04B 39/14; F04B 39/121; F04B 39/127; F04B 39/125

See application file for complete search history.

(56) References Cited

U.S. PATENT DOCUMENTS

| | | | | | |
|---|---|---|---|---|---|
| RE14,490 | E | * | 7/1918 | Kellogg | 184/6 |
| 3,496,874 | A | * | 2/1970 | Findlay | F04B 49/12 137/859 |
| RE30,680 | E | * | 7/1981 | Kress | B25F 3/00 464/178 |
| 4,527,961 | A | * | 7/1985 | Redwine | F04B 53/162 417/454 |
| 5,211,611 | A | * | 5/1993 | Lammers | F04B 9/04 475/178 |
| 5,228,842 | A | * | 7/1993 | Guebeli | B05B 9/0413 277/530 |
| 5,334,001 | A | * | 8/1994 | Williams | F04B 53/143 417/361 |
| 5,456,583 | A | * | 10/1995 | Handzel | F04B 53/22 417/454 |

(Continued)

*Primary Examiner* — Christopher S Bobish

(57) ABSTRACT

The disclosure provides an inflatable pump comprising an inflatable pump body, a plastic air cylinder and a plastic disc. A side of the inflatable pump body is provided with a bracket, the plastic air cylinder and the bracket are connected to each other through rotary joint protrusions and rotary joint holes, and the plastic disc is fastened to a top side of the plastic cylinder. By adopting the inflatable pump of the disclosure, the production and processing of the plastic air cylinder and the plastic disc is more convenient and will not cause environmental pollution. Meanwhile, the plastic air cylinder and the plastic disc can meet structural accuracy requirements of the inflatable pump. Furthermore, the plastic air cylinder and the bracket are connected to each other through rotary joint protrusions and rotary joint holes, no additional fasteners and assembly jigs are needed.

15 Claims, 5 Drawing Sheets

(56) References Cited

U.S. PATENT DOCUMENTS

| | | | | |
|---|---|---|---|---|
| 5,788,399 | A * | 8/1998 | Smearsoll | F16D 1/06 403/348 |
| 6,435,846 | B1 * | 8/2002 | Cooper | F04B 17/03 417/415 |
| 8,191,844 | B2 * | 6/2012 | Pennino | B62J 11/04 248/220.21 |
| 10,158,169 | B1 * | 12/2018 | Venghaus | H01Q 1/088 |
| 2007/0237658 | A1 * | 10/2007 | Burns | F04B 7/06 417/417 |
| 2013/0011283 | A1 * | 1/2013 | Chou | F04B 39/123 417/437 |
| 2014/0020554 | A1 * | 1/2014 | Wang | F04B 39/121 92/169.1 |
| 2015/0040310 | A1 * | 2/2015 | Long | A47K 3/022 392/471 |
| 2015/0147202 | A1 * | 5/2015 | Weiss | F04B 39/127 417/360 |
| 2015/0285236 | A1 * | 10/2015 | Chou | F04B 39/121 417/415 |
| 2016/0102661 | A1 * | 4/2016 | Chou | F04B 53/103 417/559 |
| 2019/0024649 | A1 * | 1/2019 | Kuang | F04B 35/01 |

* cited by examiner

INFLATABLE PUMP

CROSS REFERENCE TO RELATED APPLICATIONS

The present application claims the benefit of Chinese Patent Application No. 202020197312.7 filed on Feb. 21, 2020, the contents of which are incorporated herein by reference in their entirety.

FIELD OF THE INVENTION

The disclosure relates to the field of an inflatable tool, in particular to an inflatable pump.

BACKGROUND OF THE INVENTION

An inflatable pump is usually provided with a motor, an air cylinder, an air outlet disc for conveying air, a pressure gauge for pressure testing, and a connecting air-guide pipe for conveying air. An air pressure is generated by the motor and the air cylinder, and the generated air is delivered to the air-guide pipe through the air outlet disc, and is input into a tire to be inflated. A part of the air is also conveyed to the pressure gauge by the air outlet disc for pressure detection.

In the prior art, an inflatable pump generally uses a metal disc and a metal air cylinder, and the air cylinder is mounted using screws and spring washers in a fastening manner. In such an inflatable pump, the metal air cylinder needs to be processed (process steps including cutting, heat treating, fine grinding, removing bad fronts, and the like), and the metal disc needs to be processed (process steps including metal mold injection, post-processing of holes, tapping, and the like). There will also be oil pollution and metal chemical fluids during metal processing, which will pollute the environment if they are not handled properly. In addition, the assembly structure of the existing air cylinder is complicated. Specifically, there are more than 12 screws and spring washers, and four screws cannot be tightened at the same time during assembly. It is necessary to design a special assembly fixture for assembly, and the production and assembly process has more than 40 steps, which makes it difficult for workers to assemble, thereby lengthening working hours, increasing production costs and polluting the environment.

SUMMARY OF THE INVENTION

An objective of the disclosure is to provide an inflatable pump which has low production costs, simplifies assembly of the air cylinder, and reduces production man-hours of the product while avoiding environmental pollution.

Based on this, the disclosure provides an inflatable pump including an air pump main body, a plastic air cylinder, and a plastic disc. A side of the air pump main body is provided with a bracket. The plastic air cylinder and the bracket are connected with each other through rotary joint protrusions and rotary joint holes, and the plastic disc is fastened to a top side of the plastic air cylinder.

In a preferable embodiment, the bracket is provided with a mounting groove and a through hole through which a rocker arm of the inflatable pump passes; the through hole is located in the middle of the mounting groove and breaks straight through the mounting groove; a bottom side of the plastic air cylinder is disposed in the mounting groove, and the bottom side of the plastic air is abutted against a groove bottom of the mounting groove.

In a preferable embodiment, the bracket is provided with at least two rotary joint holes which are disposed around an outer periphery of the mounting groove and communicate with the mounting groove; an outer wall of the plastic air cylinder is provided with the rotary joint protrusions corresponding to the rotary joint holes, and the plastic air cylinder is clamped with the rotary joint holes through the rotary joint protrusions.

In a preferable embodiment, there are two rotary joint holes and two rotary joint protrusions. The two rotary joint holes are oppositely provided on two side walls of the mounting groove, and the rotary joint protrusions are oppositely disposed on the outer wall of the plastic air cylinder.

In a preferable embodiment, each of the rotary joint protrusions has two clip surfaces opposite to each other, and the two clip surfaces are located on a top side and a bottom side of the rotary joint protrusion, respectively. The clip surface located on the bottom side of the rotary joint protrusion is flush with the bottom surface of the plastic air cylinder.

In a preferable embodiment, the rotary joint protrusion is provided with a guide slope which is provided on one side of the rotary joint protrusion and is formed into a wedge-shaped structure.

In a preferable embodiment, the rotary joint protrusions are elastic members, an outer side wall of the rotary joint protrusion is provided with at least one deformation groove, and a groove bottom of the deformation groove is flush with the outer wall surface of the plastic air cylinder.

In a preferable embodiment, escape grooves corresponding to the rotary joint protrusion are provided in the mounting groove of the bracket and communicate with the rotary joint holes, and each of the avoidance grooves is arranged to be adjacent to the mounting groove.

In a preferable embodiment, the plastic air cylinder and the rotary joint protrusions are integrally formed, and a material of the plastic air cylinder and the plastic disc is PPS.

In a preferable embodiment, the top side of the plastic air cylinder is provided with a coupling sleeve and at least two mounting posts provided on an outer periphery of the coupling sleeve; the plastic disc is fastened to the coupling sleeve, the mounting post is provided with a first threaded hole, the plastic disc is provided with a second threaded hole corresponding to the first threaded hole, and the plastic disc is connected to the mounting posts through screws.

The implementation of the embodiments of the disclosure has the following beneficial effects:

The inflatable pump adopts a plastic air cylinder and a plastic disc which can be obtained through an injection molding process, so that the production and processing of the plastic air cylinder and the plastic disc is more convenient and will not cause environmental pollution. Meanwhile, the plastic air cylinder and the plastic disc can meet structural accuracy requirements of the inflatable pump. In addition, the plastic air cylinder and the bracket are connected each other through rotary joint protrusions and rotary joint holes, no additional fasteners and assembly jigs are needed, so that the assembly of the plastic air cylinder and the bracket is more convenient, thereby greatly reducing labor force and personnel costs, and further reducing production costs of the inflatable pump.

In the figure: 100, an inflatable pump main body; 1, a plastic air cylinder; 11, a rotary joint projection; 11*a*, a clip surface; 11*b*, a guide slope; 11*c*, a deformation groove; 12, a coupling sleeve; 13, a mounting post; 2, a plastic disc; 3, a bracket; 31, a mounting groove; 32, a through hole; 33, a rotary joint hole; 34, an escape groove; and 4, a rocker arm.

DETAILED DESCRIPTION OF PREFERRED EMBODIMENTS

The technical solutions in the embodiments of the disclosure will be clearly and completely described below with reference to the drawings in the embodiments of the disclosure. Obviously, the described embodiments are only a part of the embodiments of the disclosure, not all of the embodiments. Based on the embodiments of the disclosure, all other embodiments achieved by those skilled in the art without creative labor will fall within the protection scope of the disclosure.

It should be understood that the terms "first", "second", and the like, are used in the disclosure to describe various kinds of information. However, the information should not be limited to these terms, and these terms are only used to distinguish the same type of information from each other. For example, without departing from the scope of the disclosure, "first" information may also be referred to as "second" information. Similarly, the "second" information may also be referred to as the "first" information.

Figure 1:
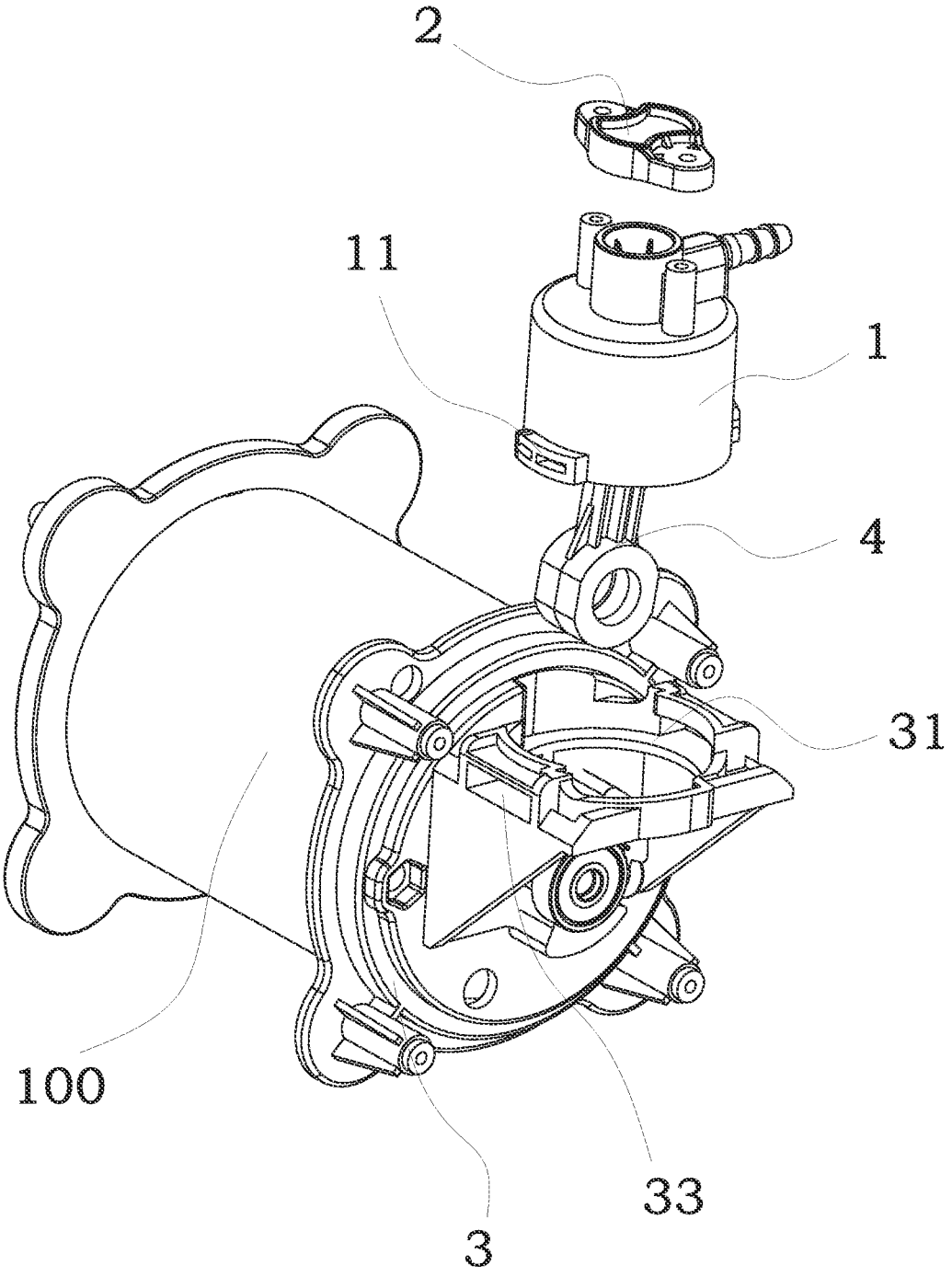
FIG. 1 is an exploded view of an inflatable pump according to an embodiment of the disclosure.
Figure 2:
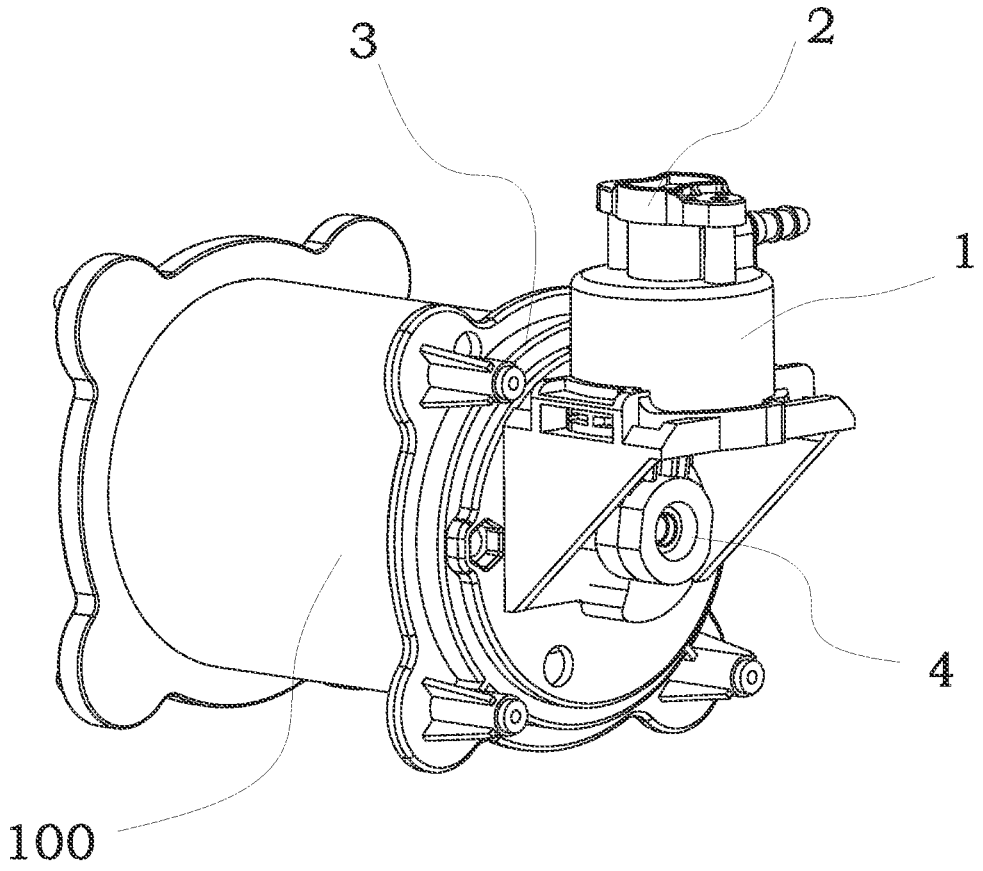
FIG. 2 is a schematic structural diagram of an inflatable pump according to an embodiment of the disclosure.
Figure 3:
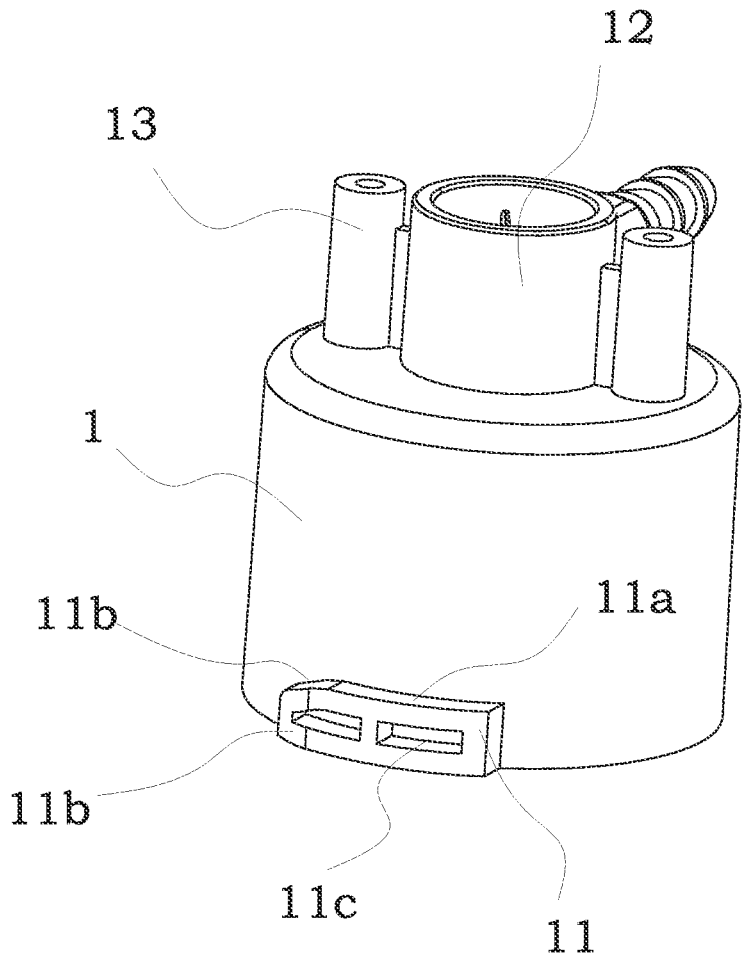
FIG. 3 is a schematic structural diagram of a plastic air cylinder according to an embodiment of the disclosure.
Figure 4:
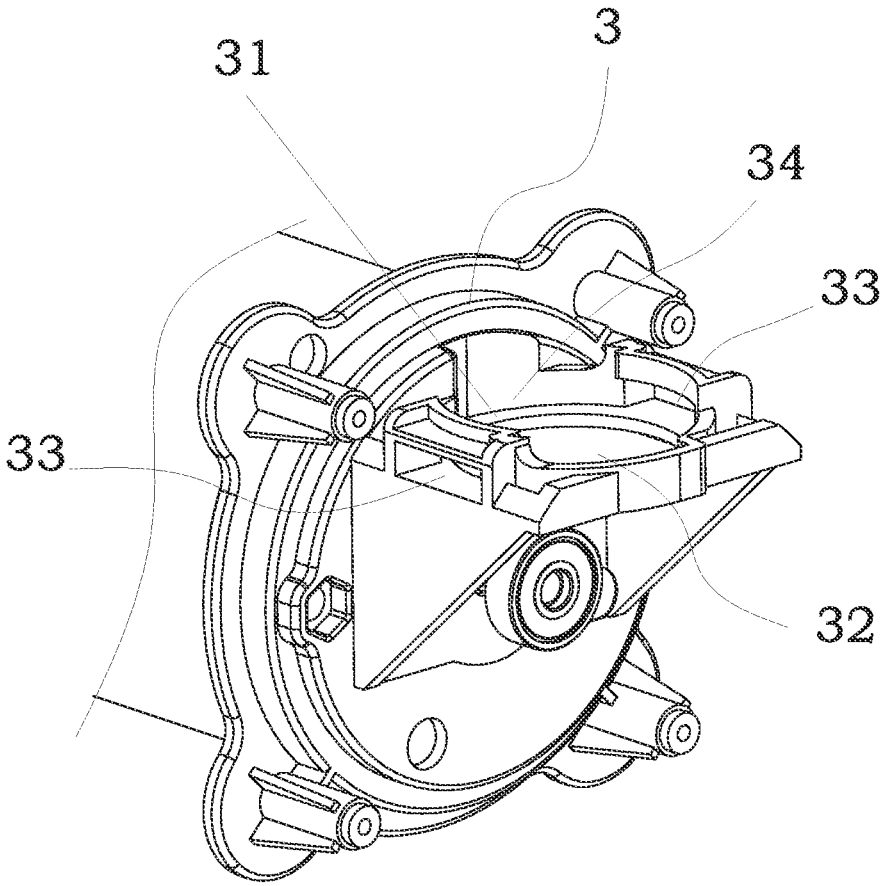
FIG. 4 is a schematic structural diagram of one part of a bracket according to an embodiment of the disclosure.
Figure 5:
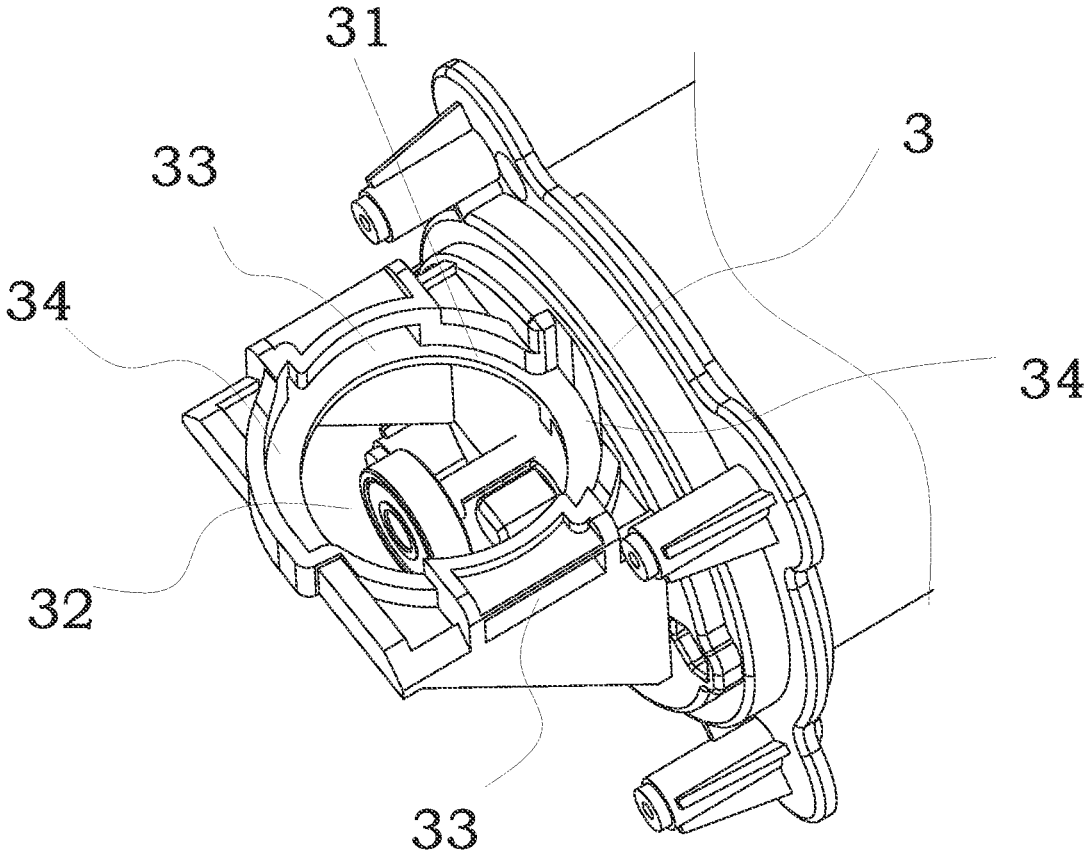
FIG. 5 is a schematic structural diagram of another part of a bracket according to an embodiment of the disclosure.

As shown in FIGS. 1 to 5, this embodiment provides an inflatable pump, which comprises an air pump main body 100, a plastic air cylinder 1 and a plastic disc 2, a side of the air pump main body 100 is provided with a bracket 3. It should be noted that, the air pump main body 100 in the embodiment mainly includes a housing and a motor disposed in the housing. The motor is connected to a piston of the air cylinder through a rocker arm 4 so as to realize the air pumping function of the inflatable pump. The above structure is an existing structure of the inflatable pump, and will not be described in detail here. The plastic air cylinder 1 and the bracket 3 are connected with each other through rotary joint protrusions 11 and rotary joint holes 33, and the plastic disc 2 is fastened to a top side of the plastic air cylinder 1. In the embodiment, both the air cylinder and the disc are made of a plastic material, and the plastic parts are produced by an injection molding process. The injection molding process is currently very mature, stable and reliable, and the size and accuracy of a workpiece can meet design requirements. The structures, such as that of threads and rotary joint protrusions 11, can be obtained through an injection molding process, which ensures convenient processing and production of the plastic air cylinder 1 and the plastic disc 2. In addition, compared with metal air cylinders and metal discs in the prior art, the plastic air cylinder 1 and the plastic disc 2 have features of little production pollution and low costs. Furthermore, the plastic air cylinder 1 and the bracket 3 are connected to each other through rotary joint protrusions 11 and rotary joint holes 33, no additional fasteners and assembly jigs are needed, so that the assembly of the plastic air cylinder 1 and the bracket 3 is more convenient, thereby greatly reducing labor force and personnel costs, and further reducing production costs of the inflatable pump.

Based on the above technical solution, the inflatable pump adopts the plastic air cylinder 1 and the plastic disc 2 which can be obtained through an injection molding process, so that the production and processing of the plastic air cylinder 1 and the plastic disc 2 is more convenient and will not cause environmental pollution. Meanwhile, the plastic air cylinder 1 and the plastic disc 2 can meet structural accuracy requirements of the inflatable pump. In addition, the plastic air cylinder 1 and the bracket 3 are connected through rotary joint protrusions 11 and rotary joint holes 33, no additional fasteners and assembly jigs are needed, so that the assembly of the plastic air cylinder 1 and the bracket 3 is more convenient, thereby greatly reducing labor force and personnel costs, and further reducing production costs of the inflatable pump.

In this embodiment, the bracket 3 is provided with a mounting groove 31 and a through hole 32 through which a rocker arm 4 of the inflatable pump passes. It should be noted that the rocker arm 4 is provided on the side of the air pump body 100, and one end of the rocker arm 4 extends into the plastic air cylinder 1 through the through hole 32. The through hole 32 is located in the middle of the mounting groove 31 and breaks straight through the mounting groove 31; a bottom side of the plastic air cylinder 1 is disposed in the mounting groove 31, and the bottom side of the plastic air cylinder 1 is abutted against a groove bottom of the mounting groove 31. The mounting groove 31 enables the bottom of the plastic air cylinder 1 to be stably installed, so that the installation structure of the plastic air cylinder 1 is more reasonable.

Preferably, the bracket 3 is provided with at least two rotary joint holes 33 which are disposed around an outer periphery of the mounting groove 31 and communicate with the mounting groove 31; an outer wall of the plastic air cylinder 1 is provided with the rotary joint protrusions 11 corresponding to the rotary joint holes 33, and the plastic air cylinder 1 is clamped with the rotary joint holes 33 through the rotary joint protrusions 11. The bracket 3 is provided with the rotary joint holes 33, and the rotary joint protrusions 11 are provided on the plastic air cylinder 1, which is convenient to connect the plastic air cylinder 1 and the bracket 3. In an exemplary embodiments, the rotary joint protrusions 11 can also be provided on the bracket 3, and the plastic air cylinder 1 is correspondingly provided with rotary joint holes 33. However, the above structure will destroy the overall structure of the plastic air cylinder 1, and is not convenient for processing. Therefore, this embodiment is a preferred technical solution.

Wherein, there are two rotary joint holes 33 and two rotary joint protrusions 11. The two rotary joint holes 33 are oppositely provided on two side walls of the mounting groove 31, and the rotary joint protrusions 11 are oppositely disposed on the outer wall of the plastic air cylinder 1. The structure of two sets of rotary joint protrusions 11 and rotary joint holes 33 can ensure that the connection between the plastic air cylinder 1 and the bracket 3 is firm and stable, and three or four sets of rotary joint structures can also be used according to actual needs. In this embodiment, two sets of rotary joint protrusions 11 and rotary joint holes 33 are used to simplify the connection structure while ensuring connection reliability, and further simplify the processing of the plastic air cylinder 1 and the bracket 3.

Further, each of the rotary joint protrusions 11 has two clip surfaces 11*a* opposite to each other, and the two clip surfaces 11*a* are located on a top side and a bottom side of the rotary joint protrusion 11, respectively. The clip surface 11*a* located on the bottom side of the rotary joint protrusion 11 is flush with the bottom surface of the plastic air cylinder 1. The rotary joint protrusions 11 have a block structure, which ensures that the rotary joint protrusions 11 can be stably connected in the rotary joint holes 33. The clip surface 11*a* located on the bottom side of the rotary joint protrusion 11 is flush with the bottom surface of the plastic air cylinder 1, so that the arrangement of the rotary joint protrusions 11 is more reasonable.

Specifically, the rotary joint protrusion 11 is provided with a guide slope 11*b* which is provided on one side of the rotary joint protrusion 11 and is formed into a wedge-shaped structure, which is more convenient to connect the rotary joint protrusions 11 and the rotary joint holes 33 to each other. The wedge-like structure of each rotary joint screwing protrusion 11 can play a guiding role, so that the rotary joint protrusions 11 can more easily enter the rotary joint holes 33 to realize connection. Preferably, the rotary joint protrusions 11 are elastic members, an outer side wall of the rotary joint protrusion 11 is provided with at least one deformation groove 11*c*, and a groove bottom of the deformation groove 11*c* is flush with the outer wall surface of the plastic air cylinder 1, so that when the rotary joint protrusions 11 are rotated into the rotary joint holes 33, a slight deformation may occur, thereby ensuring easy disassembly and assembly between the rotary joint protrusions 11 and the rotary joint holes 33.

Furthermore, escape grooves 34 corresponding to the rotary joint protrusions 11 are provided in the mounting groove 31 of the bracket 3 and communicate with the rotary joint holes 33, and each of the avoidance grooves 34 is arranged to be adjacent to the mounting groove. Based on this structure, the rotary joint protrusions 11 extend into the respective mounting grooves 31 along the escape grooves 34; and the plastic air cylinder 1 is rotated so that the rotary joint protrusions 11 rotate into the respective escape grooves 34 along the escape grooves 34 for connection. During disassembly, the rotary joint protrusions 11 are rotated into the respective escape grooves 34 along the rotary joint holes 33, so that the rotary joint structure of the bracket 3 and the plastic air cylinder 1 is more reasonable.

In this embodiment, the plastic air cylinder 1 and the rotary joint protrusions 11 are integrally formed, which ensures that the production and processing of the plastic aid cylinder 1 is more convenient. The plastic air cylinder 1 and the rotary joint protrusions 11 in this embodiment can be obtained by injection molding. The plastic air cylinder 1 and the plastic disc 2 are made of PPS. PPS has properties of high temperature resistance and high strength, which meets mounting requirements of the plastic air cylinder 1 and the plastic disc 2.

Preferably, the top side of the plastic air cylinder 1 is provided with a coupling sleeve 12 and at least two mounting posts 13 provided on an outer periphery of the coupling sleeve 12; the plastic disc 2 is fastened to the coupling sleeve 12, the mounting post 13 is provided with a first threaded hole, the plastic disc 2 is provided with a second threaded hole corresponding to the first threaded hole, and the plastic disc 2 is connected to the mounting posts 12 through screws. Therefore, the connection between the plastic disc 2 and the plastic air cylinder 1 is convenient, and the connection stability is guaranteed to meet the requirements of the inflatable pump.

In the inflatable pump of the embodiments of the disclosure, which comprises the plastic air cylinder 1 and the plastic disc 2, the plastic air cylinder 1 and the plastic disc 2 can be obtained through an injection molding process and the production and processing of the plastic air cylinder 1 and the plastic disc 2 is more convenient and will not cause environmental pollution. At the same time, the plastic air cylinder 1 and the plastic disc 2 can meet structural accuracy requirements of the inflatable pump. In addition, the plastic air cylinder 1 and the bracket 3 are connected through the rotary joint protrusions 11 and the rotary joint holes 33, no additional fasteners and assembly jigs are needed, so that the assembly of the plastic air cylinder 1 and the bracket 3 is more convenient, thereby greatly reducing labor force and personnel costs, and further reducing production costs of the inflatable pump.

In the description of the disclosure, it should be understood that the directions or positional relationships indicated by the terms "upper", "lower", "left", "right", "top", "bottom" and the like are shown based on the orientation or positional relationship shown in the drawings, and are only for convenience of describing the disclosure and simplifying the description, rather than indicating or implying that the indicated devices or elements must have a specific orientation, or are configured and operated in a specific orientation, therefore they cannot be understood as limits to the disclosure.

The above are only preferred embodiments of the disclosure. It should be noted that a number of improvements and replacements can be made by those of ordinary skill in the art without departing from the technical principles of the disclosure. These improvements and replacements should also fall into the protection scope of the disclosure.

What is claimed is:

1. An inflatable pump, wherein the inflatable pump comprises an air pump main body, a plastic air cylinder and a plastic disc; a side of the air pump main body is provided with a bracket, the plastic air cylinder and the bracket are connected to each other through rotary joint protrusions and rotary joint holes, and the plastic disc is fastened to a top side of the plastic air cylinder;

the bracket is provided with a mounting groove and a through hole through which a rocker arm of the inflatable pump passes; the through hole is located in the middle of the mounting groove and breaks straight through the mounting groove; a bottom side of the plastic air cylinder is disposed in the mounting groove, and the bottom side of the plastic air cylinder is abutted against a groove bottom of the mounting groove;

the bracket is provided with at least two rotary joint holes which are disposed around an outer periphery of the mounting groove and communicate with the mounting groove; an outer wall of the plastic air cylinder is provided with the rotary joint protrusions corresponding to the rotary joint holes, and the plastic air cylinder is clamped with the rotary joint holes through the rotary joint protrusions; and the rotary joint protrusion is an elastic member, an outer side wall of the rotary joint protrusion is provided with at least one deformation groove, and a groove bottom of the deformation groove is flush with the outer wall surface of the plastic air cylinder.

2. The inflatable pump according to claim 1, wherein there are two rotary joint holes and two rotary joint protrusions, the two rotary joint holes are oppositely provided on two side walls of the mounting groove, and the two rotary joint protrusions are oppositely disposed on the outer wall of the plastic air cylinder.

3. The inflatable pump according to claim 1, wherein each of the rotary joint protrusions has two clip surfaces opposite to each other, and the two clip surfaces are located on a top side and a bottom side of the rotary joint protrusion, respectively; and the clip surface located on the bottom side of the rotary joint protrusion is flush with the bottom surface of the plastic air cylinder.

4. The inflatable pump according to claim 1, wherein the rotary joint protrusion is provided with a guide slope which is provided on one side of the rotary joint protrusion and is formed into a wedge-shaped structure.

5. The inflatable pump according to claim 1, wherein escape grooves corresponding to the respective rotary joint protrusions are provided in the mounting groove of the bracket and communicate with the rotary joint holes, and each of the escape grooves is arranged to be adjacent to the mounting groove.

6. The inflatable pump according to claim 1, wherein the plastic air cylinder and the rotary joint protrusions are integrally formed, and a material of the plastic air cylinder and the plastic disc is PPS.

7. The inflatable pump according to claim 1, wherein, the top side of the plastic air cylinder is provided with a coupling sleeve and at least two mounting posts provided on an outer periphery of the coupling sleeve; the plastic disc is fastened to the coupling sleeve, the mounting post is provided with a first threaded hole, the plastic disc is provided with a second threaded hole corresponding to the first threaded hole, and the plastic disc is connected to the mounting posts through screws.

8. The inflatable pump according to claim 2, wherein the plastic air cylinder and the rotary joint protrusions are integrally formed, and a material of the plastic air cylinder and the plastic disc is PPS.

9. The inflatable pump according to claim 3, wherein the plastic air cylinder and the rotary joint protrusions are integrally formed, and a material of the plastic air cylinder and the plastic disc is PPS.

10. The inflatable pump according to claim 4, wherein the plastic air cylinder and the rotary joint protrusions are integrally formed, and a material of the plastic air cylinder and the plastic disc is PPS.

11. The inflatable pump according to claim 5, wherein the plastic air cylinder and the rotary joint protrusions are integrally formed, and a material of the plastic air cylinder and the plastic disc is PPS.

12. The inflatable pump according to claim 2, wherein, the top side of the plastic air cylinder is provided with a coupling sleeve and at least two mounting posts are provided on an outer periphery of the coupling sleeve; the plastic disc is fastened to the coupling sleeve, each of the at least two mounting posts are provided with a respective first threaded hole, the plastic disc is provided with second threaded holes corresponding to the respective first threaded holes, and the plastic disc is connected to the mounting posts through screws.

13. The inflatable pump according to claim 3, wherein, the top side of the plastic air cylinder is provided with a coupling sleeve and at least two mounting posts are provided on an outer periphery of the coupling sleeve; the plastic disc is fastened to the coupling sleeve, each of the at least two mounting posts are provided with a respective first threaded hole, the plastic disc is provided with second threaded holes corresponding to the respective first threaded holes, and the plastic disc is connected to the mounting posts through screws.

14. The inflatable pump according to claim 4, wherein, the top side of the plastic air cylinder is provided with a coupling sleeve and at least two mounting posts are provided on an outer periphery of the coupling sleeve; the plastic disc is fastened to the coupling sleeve, each of the at least two mounting posts are provided with a respective first threaded hole, the plastic disc is provided with second threaded holes corresponding to the respective first threaded holes, and the plastic disc is connected to the mounting posts through screws.

15. The inflatable pump according to claim 5, wherein, the top side of the plastic air cylinder is provided with a coupling sleeve and at least two mounting posts are provided on an outer periphery of the coupling sleeve; the plastic disc is fastened to the coupling sleeve, each of the at least two mounting posts are provided with a respective first threaded hole, the plastic disc is provided with second threaded holes corresponding to the respective first threaded holes, and the plastic disc is connected to the mounting posts through screws.

* * * * *